United States Patent [19]

Asano et al.

[11] Patent Number: 4,578,160

[45] Date of Patent: Mar. 25, 1986

[54] METHOD FOR ELECTROLYZING DILUTE CAUSTIC ALKALI AQUEOUS SOLUTION BY PERIODICALLY REVERSING ELECTRODE POLARITIES

[75] Inventors: Hiroshi Asano, Kanagawa; Takayuki Shimamune, Tokyo; Kazuhiro Hirao, Kanagawa, all of Japan

[73] Assignee: Permelec Electrode Ltd., Kanagawa, Japan

[21] Appl. No.: 590,668

[22] Filed: Mar. 19, 1984

[30] Foreign Application Priority Data

Mar. 18, 1983 [JP] Japan ..... 58-44076
Mar. 18, 1983 [JP] Japan ..... 58-44077

[51] Int. Cl.[4] ..... C25B 1/46
[52] U.S. Cl. ..... 204/98; 204/128
[58] Field of Search ..... 204/98, 128, 228

[56] References Cited

U.S. PATENT DOCUMENTS

| | | | |
|---|---|---|---|
| 3,282,834 | 11/1966 | Justi et al. | 204/98 |
| 3,600,286 | 8/1971 | Sabins | 204/128 |
| 4,253,922 | 3/1981 | Welch | 204/98 |
| 4,306,952 | 12/1981 | Jansen | 204/228 |
| 4,308,122 | 12/1981 | Das Gupth et al. | 204/228 |
| 4,326,938 | 4/1982 | Das Gupth et al. | 204/228 |

*Primary Examiner*—John F. Niebling
*Assistant Examiner*—Terryence Chapman
*Attorney, Agent, or Firm*—Sughrue, Mion, Zinn, Macpeak and Seas

[57] ABSTRACT

A method for electrolyzing a dilute caustic alkali aqueous solution in an electrolytic cell partitioned by a cation exchange membrane using iron, nickel or their base alloys as an electrode, and an apparatus thereof whereby the polarities of the electrodes are periodically reversed.

13 Claims, 7 Drawing Figures

METHOD FOR ELECTROLYZING DILUTE CAUSTIC ALKALI AQUEOUS SOLUTION BY PERIODICALLY REVERSING ELECTRODE POLARITIES

FIELD OF THE INVENTION

This invention relates to a method for electrolyzing a dilute caustic alkali aqueous solution in an electrolytic cell partitioned by a cation exchange membrane using iron, nickel or their base alloys as an electrode, and an apparatus thereof.

BACKGROUND OF THE INVENTION

Solutions containing caustic alkali are industrially discharged from various production processes, treating processes or processing processes. Examples of such solutions include reaction waste solutions from various chemical reaction processes, waste solutions from treating metals with alkali, waste solutions from regenerating ion exchange resins, alkali-treating waste solutions from petroleum refining processes, alkali-treating waste solutions from nuclear energy facilities and the like. It is industrially important to recover caustic alkali from these waste solutions in view of both the economics of the processes and prevention of pollution.

For these reasons, various methods for recovering or detoxicating caustic alkali by treating these waste solutions have heretofore been tried. Most of these alkali-containing waste solutions are aqueous solutions of a relatively low concentration and contain many other inorganic or organic coexisting substances. Therefore, the solutions are often discharged after detoxicating by neutralization, etc. without a recovering treatment, for technical or economic reasons.

Electrolytic methods using a cation exchange membrane are known as representative methods for effectively recovering caustic alkali from these waste solutions. For example, a method for treating an alkaline waste water which comprises separating and recovering an alkali from the alkaline waste water by electrodialysis using a cation exchange membrane and discharging the waste water as a neutralized water is described in Published Unexamined Japanese Patent Application 16859/1977.

However, such electrolytic methods are disadvantageous since material which is highly durable in an oxygen generating reaction is required as an electrode, particularly as an anode, and expensive noble metal or easily exhaustive graphite, which has various disadvantages in production or operation, must be used.

Accordingly, it is desired to develop a technically and economically excellent electrolytic technology which can be industrially operable.

Iron, nickel and their base alloys such as stainless steel, etc. are inexpensive, easy to process and, thus, have heretofore been used as an electrode for electrolysis of a caustic alkali aqueous solution in water electrolysis, etc. However, these materials can only be used in an aqueous solution having a high caustic alkali concentration and at a relatively high temperature. These materials cannot be used as an electrode when electrolyzing a low concentration caustic alkali aqueous solution because deactivation occurs by formation of an oxide on the surface of the electrode due to considerable oxidation of the anode by elevation of the electrolytic voltage or because dissolution of the surface of the anode occurs at a low caustic alkali concentration of about 10 wt% or less, particularly 5 wt% or less.

Furthermore, in the case of electrolysis of a waste solution containing various organic substances and heavy metals, these impurities attach and precipitate onto the ion exchange membrane, electrode or pipes, and make the electrolysis difficult.

SUMMARY OF THE INVENTION

Accordingly, an object of the present invention is to overcome the above-described problems and to provide a novel electrolysis method which can recover caustic alkali effectively by electrolyzing a dilute caustic alkali aqueous solution in a stable manner for a long period of time using inexpensive iron, nickel, etc. as an electrode, and an apparatus thereof.

In one embodiment, the electrolysis method according to this invention comprises supplying and electrolyzing a dilute caustic alkali aqueous solution in one electrode compartment of an electrolytic cell partitioned by a cation exchange membrane and recovering a concentrated caustic alkali aqueous solution from the other electrode compartment, wherein iron, nickel or their base alloys is used as an electrode material and the electrolysis is conducted for a certain period of time such that an electric current is applied in a reverse direction with the polarity being inverted after every electrolysis by applying an electric current in a positive direction.

In another embodiment, the electrolysis is further conducted for a certain period of time such that the directions of supplying and discharging the electrolyte are reversed and then the electric current is applied in a reverse direction with the polarity being inverted after every electrolysis by applying an electric current in a negative direction.

The electrolysis apparatus according to this invention comprises an electrolysis cell partitioned by a cation exchange membrane, wherein (a) iron, nickel or their base alloys is used as an electrode material for electrodes in the two electrode compartments, (b) the two electrode compartments and the electrolyte supply and discharge means therein have the same shape, (c) the electrolysis cell is symmetrical about the line corresponding to the cation exchange membrane or the electrode, and (d) inversing the electrode polarity and reversing the electrolyte the electrode polarity and reversing the electrolyte supply and discharge directions are freely possible.

This invention achieves the above-mentioned objects by electrolyzing in a manner such that the polarity of the electrode is periodically inverted with the prescribed amount of electric current applied or, further, the electrolyte supply and discharge directions and the direction of the electric current applied are reversed and then the polarity of the electrode is periodically inverted with the prescribed amount of electric current applied.

This invention exhibits an excellent effect and makes it possible to conduct electrolysis of a dilute caustic alkali aqueous solution in a stable manner for a long period using an inexpensive electrode such as iron, nickel, etc.

1: Cation exchange membrane
2,3,7: Compartments
4,5: Electrodes
6: Bipolar electrode
8,8': Tanks
9,9': Pipes
10,10': Pumps
11,11': Solution supplying pipes
12,12': Exhaust pipes

DETAILED DESCRIPTION OF THE INVENTION

The electrolytic cell used in this invention is an electrolytic cell partitioned by a cation exchange membrane and can be of any type such as a monopolar electrode, a bipolar electrode, etc.

Figure 1:
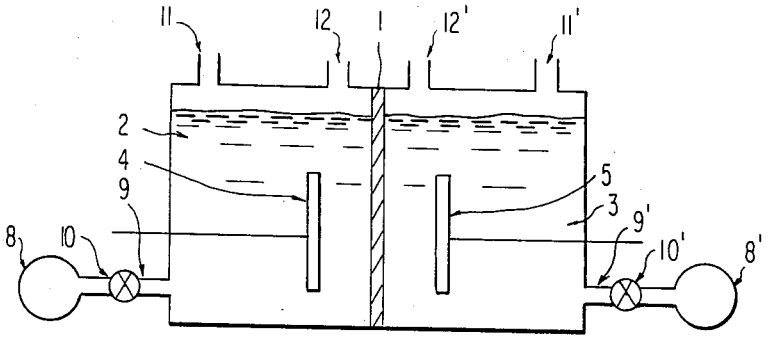
FIG. 1 shows an example of the electrolysis apparatus according to this invention.

The electrolysis apparatus shown in FIG. 1 is a basic monopolar electrode-type electrolytic cell, in which compartments 2 and 3 are formed by partitioning with a cation exchange membrane 1, and electrolysis is conducted by applying an electric current through electrodes 4 and 5.

Figure 2:
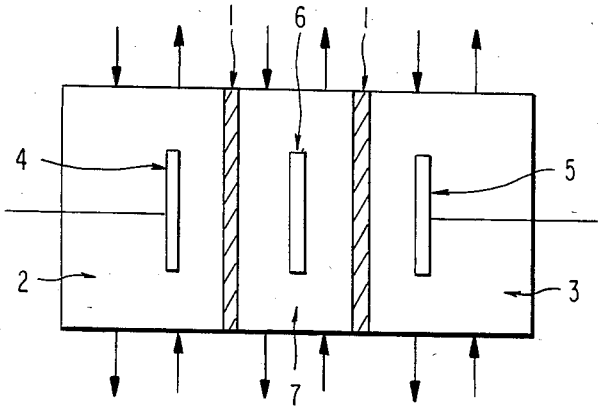
FIG. 2 shows another example of the electrolytic apparatus according to this invention.

FIG. 2 shows an example of a bipolar electrode-type electrolytic cell of this invention, in which the cation exchange membrane 1 and a bipolar electrode 6 are successively placed between terminal electrodes 4 and 5. Middle compartment is shown as 7 and a plurality of middle compartments can be arranged to form a multi-compartment bipolar electrode-type electrolytic cell. Since the same electrode material can be used as the anode and cathode, this invention is advantageous, particularly in the case of a bipolar electrode-type electrolytic cell, due to the lack of need for combining different materials for forming the bipolar electrode. Any conventional cation exchange membrane durable under the electrolytic conditions can be used as the cation exchange membrane 1. Fluorine-containing resins, such as an alkali-resistant perfluoro ion exchange membrane, are particularly preferred.

Iron, nickel or their base alloys are used as the material of electrode 4, 5 or 6. For instance, carbon steel, Fe-Ni alloy, stainless steel, alloys with Co, Cr or Mo, etc. can be used as the alloy materials. Each electrode can be composed of the same material of these electrode materials or a combination of different materials.

The electrolytic cell is usually equipped with supplying and discharging devices for supplying the electrolyte and discharging the product. In addition to these devices, the electrolytic apparatus of this invention has a symmetrical form with the center of the cation exchange membrane 1 or electrode 6, and the direction of applying an electric current and the direction of liquid flow can be inverted at any time in this invention. In the multi-compartment bipolar electrode-type electrolytic cell shown in FIG. 2, the middle cation exchange membrane becomes the center of symmetry in the case of using an odd number of cation exchange membranes, and the middle bipolar electrode becomes the center of symmetry in the case of using an even number of cation exchange membranes.

For instance, in FIG. 1, an electrolytic apparatus is composed symmetrically with the center of the cation exchange membrane 1, wherein the same shaped tanks 8 and 8', pipes 9 and 9' and pumps 10 and 10', which can supply or discharge the electrolyte, are placed at left-hand and right-hand compartments 2 and 3, and optionally solution supplying pipes 11 and 11', exhaust pipes 12 and 12', etc. are placed if necessary and desired.

The electrode using iron, nickel, etc. has good electroconductivity, can easily be shaped into any form such as a rod, a plate, a mesh, a porous plate, etc. and is inexpensive. However, in the conventional electrolysis method, particularly if such an electrode is used in electrolysis of a dilute aqueous solution or waste solution containing caustic alkali, the continuation of electrolysis becomes difficult because the surface of the anode is deactivated by the formation of oxides due to oxidation, and impurities are deposited and adhered on many portions of the electrolysis apparatus, such as the cation exchange membrane, the cathode, the pipes, etc., thereby making it difficult to continue electrolysis.

This invention is based on the novel findings that the above-described problems in the conventional method can be overcome and electrolysis of a dilute caustic alkali-containing aqueous solution can be achieved in a stable manner for a long period if the electrolysis is conducted for a certain period of time such that an electric current is applied in a reverse direction with the polarity of the electrode being inverted after every electrolysis by applying an electric current in a positive direction or, further, the electrolysis is conducted for a certain period of time such that the directions of supplying and discharging the electrolyte are reversed and then the electric current is applied in a reverse direction with the polarity of the electrodes being inverted after every application of an electric current in a negative direction, even if the above electrodes are used.

The method for applying an electric current of this invention is explained in detail by reference to the accompanying drawings.

Figure 3:
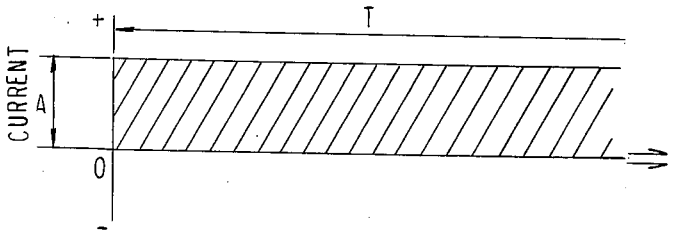
FIG. 3 shows the general current-applying pattern in the conventional electrolysis method.

FIG. 3 shows the conventional electric-current-applying method for electrolysis. An electric current is applied through the anode in a positive direction at a prescribed current value A for a time T.

Figure 4:
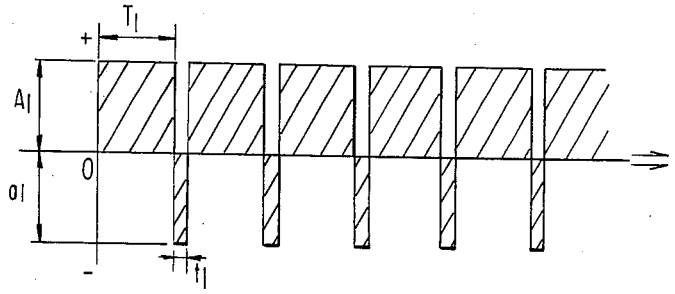
Figure 5:
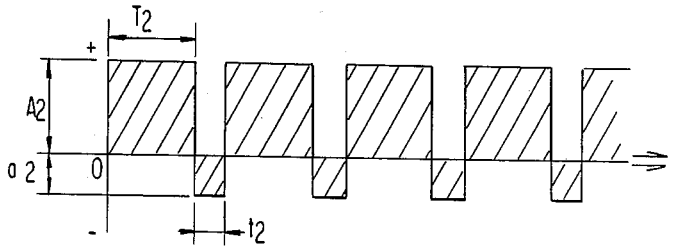
Figure 6:
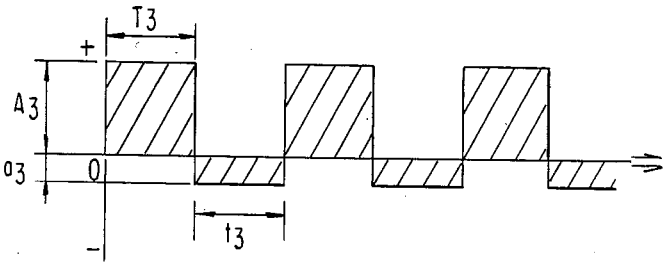

On the other hand, according to this invention, an electric current is applied in a reverse direction at prescribed current values $a_1$, $a_2$ and $a_3$ for prescribed times $t_1$, $t_2$ and $t_3$ with the polarity of the electrodes being inverted after every electrolysis of applying an electric current in a positive direction at the current values $A_1$, $A_2$ and $A_3$ for prescribed time $T_1$, $T_2$ and $T_3$ as shown in FIGS. 4 to 6.

The reason that the above-mentioned effects of this invention are achieved by this operation is not entirely clear. However, it is believed that the deactivation of the electrode is prevented and further that the activity is recovered by the periodic reverse application of the electric current. Particularly, it has been confirmed that, in the anode, the oxides formed as electrolysis proceeds disappear by the reductive action and an active surface is recovered. Furthermore, although impurities such as metal ions, in general, reductively precipitate and adhere onto the surface of the cathode, the surface is cleaned by applying an electric current in a reverse direction. This cleaning action is also effective in removing obstacles which precipitate and adhere onto the cation exchange membrane used.

The current-applying time in the positive direction is desired to be as long as possible in view of the purpose of electrolysis. However, if the time is too long, the electrode is deactivated and recovery of activity becomes difficult. Therefore, the time is limited to a certain time. Usually, it is safe to set the time to be about 15 minutes or less, whereby the activity of the electrode can be easily recovered and electrolysis can be conducted in a stable manner for a long period of time.

On the other hand, the current amount applied in the reverse direction is desired to be as small as possible because the application in the reverse direction reduces the efficiency of the intended electrolysis, but the current amount applied must be sufficient to recover the activity of electrode. It has been confirmed that the object of this invention can be achieved effectively by setting the current amount in the reverse direction to be about 3 to 30% of the current amount in the positive direction.

FIG. 4 shows a typical pattern of applying an electric current in the electrolysis method of this invention. Electrolysis is conducted by applying an electric current in a positive direction at a fixed current $A_1$ for a prescribed time $T_1$ and then applying an electric current in a reverse direction at the same current ($a_1=-A_1$) for a prescribed time $t_1$. Electrolysis is continued by repeating the above-mentioned operations. In this case, the current amounts are represented by $A_1 \times T_1$ and $-A_1 \times t_1$ (the area of the hatching portion in the figure), respectively, and the ratio is determined only by the ratio of each current-applying time. Thus, the operation is simple because only control of the time for inverting a polarity is required. For example, if $T_1$ is 10 minutes, the current-applying time in the reverse direction $t_1$ is about 18 seconds to about 3 minutes according to this invention. Then, setting $t_1$ to an appropriate time within the above range, e.g., 1 minute, it is easy to conduct electrolysis under automatic control of a power source of the electrolytic cell by means of an automatic timer so as to invert the polarity of the electrode at that cycle.

The current-applying pattern shown in FIG. 5 is an example of electrolysis in which both current $a_2$ and current-applying time $t_2$ in the reverse direction are changed against current $A_2$ and current-applying time $T_2$ in a positive direction.

FIG. 6 shows an example of electrolysis in which the current-applying times in the positive direction and the reverse direction are the same ($t_3=T_3$) and the applying current in the reverse direction $a_3$ is smaller than in the positive direction $A_3$.

Thus, in this invention, any current-applying method in which the current amount in the reverse direction becomes periodically from 3 to 30% of that in the positive direction can be applicable.

Another current-applying method of this invention is explained in detail by reference to FIG. 7.

First, one compartment is made to be an anode compartment and an electric current is applied in a reverse direction at a prescribed current value $a_4$ for a prescribed time $t_4$ every electrolyzing by applying an electric current in a positive direction at a prescribed current value $A_4$ for a prescribed time $T_4$. After conducting the above operation for a certain period L, the compartment is made to be a cathode compartment, an electric current is applied in a reverse direction at a prescribed current value $a'_4$ for a prescribed time $t'_4$ by inverting the polarity every electrolysis by applying an electric current in a negative direction for a prescribed time $T'_4$ with inverting the supplying and discharging direction of the electrolyte, and this operation is conducted for a certain period L'. Electrolysis is continued in the same manner.

As mentioned above, the deactivation of the electrode is prevented and further, the activity is recovered by applying an electric current in the reverse direction periodically. Moreover, the current-application in the reverse direction is also effective for the removal of cleaning of the impurity metals which reductively precipitate on the anode surface and the obstacles which precipitate and adhere on the cation exchange membrane.

On the other hand, the above-mentioned electrochemical action becomes more effective and, at the same time, removal or cleaning of the scale deposited on the membranes, pipes, etc. is effectively performed by the physical action of the backward flow of the solution because the flow direction of the whole solution of the electrolytic apparatus as well as the current-applying direction is inverted periodically every electrolysis for a fixed time.

Although long current-applying times $T_4$ and $T'_4$ at prescribed current values $A_4$ and $A'_4$ in the positive direction or the negative direction are desirable for the purpose of electrolysis, it should be limited to certain times because electrolysis for too long a time causes the deactivation of the electrode and also makes the recovery of the activity by applying an electric current in the reverse direction difficult. Usually, it is safe to prescribe the time to be about 15 minutes or less, whereby the activity of the electrode can be easily recovered.

On the other hand, it is preferred that the current amount in the reverse direction should be as small as possible so far as the activity of the electrode can be sufficiently recovered because the current application in the reverse direction at current values $a_4$ and $a'_4$ and current-applying times $t_4$ and $t'_4$ reduces the efficiency of the intended electrolysis. It has been confirmed that the objects of this invention can be achieved effectively by setting the current amount in the reverse direction $a_4 \times t_4$ or $a'_4 \times t'_4$ to be about 3 to 30% of the current amounts in the positive direction or negative direction $A_4 \times T_4$ or $A'_4 \times T'_4$. For example, when $a_4=-A_4$ and $T_4$ is 10 minutes, $t_4$ ranges about 18 seconds to about 3 minutes in this invention.

The electrolysis under periodic current-application in the reverse direction is conducted for a fixed period L and then electrolysis is similarly conducted for a fixed period L' after inverting the supplying and discharging direction of electrolyte. Then, a long period of electrolysis is conducted by repeating such operations. The period L or L' for which the electrolysis in one direction is continued can be optionally determined but, usually, it is preferred to be between 100 and 1000 hours in view of the achievement of the effects of this invention.

Figure 7:
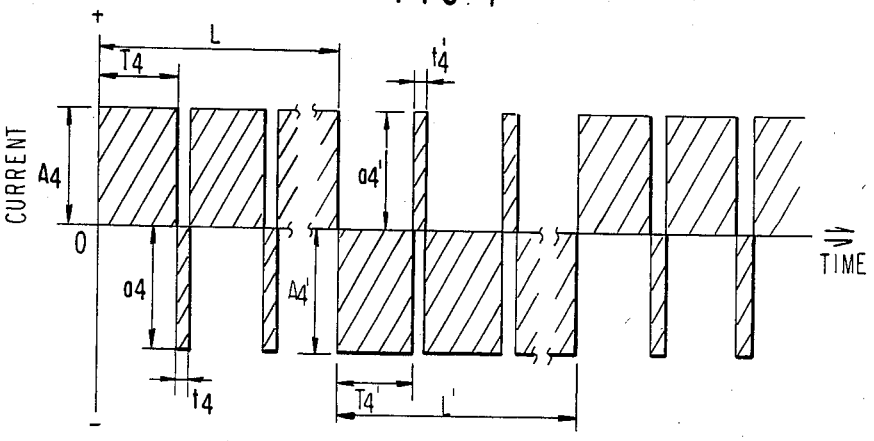
FIGS. 4 to 7 show examples of the current-applying pattern in the electrolysis method according to this invention.

In the current-applying pattern shown in FIG. 7, operation is simplest when the current values in the positive direction and negative direction are the same ($A_4=A'_4=-a_4=-a'_4$) and each current-applying time is constant ($T_4=T'_4$, $t_4=t'_4$, $L=L'$) because then only the control of the period for inverting the polarity is required. However, it is possible to change each current value $A_4$, $A'_4$, $a_4$ or $a'_4$, each current-applying time $T_4$, $T'_4$, $t_4$ or $t'_4$ and each electrolyzing period L and L', unless it departs from the objects of this invention.

The following examples are provided for illustrative purposes and are in no way intended to limit the scope of the present invention.

EXAMPLE 1

An electrolytic cell was partitioned by a cation exchange membrane (trade name Nafion 315, manufactured by Dupont) and a stainless steel plate (SUS 316) of 6 cm×6 cm size and 1 mm thickness was used as the electrode material for both the anode and cathode. A 0.5% NaOH aqueous solution was supplied into the anode compartment and the electrolysis was conducted at 60° C. at a current density of 30 A/dm$^2$ by changing the current-applying time in the reverse direction according to the current-applying pattern shown in FIG. 4. The cathode compartment was at first filled with a 10% NaOH aqueous solution, then a 0.2% NaOH aqueous solution was discharged from the anode compartment and a 12% NaOH aqueous solution was discharged from the cathode compartment. The results obtained are shown in Table 1.

Electrode life was judged at the point of 2.0 V elevation of electrolysis voltage from the initial value.

TABLE 1

| | Current-applying Time | | Electrode Life (hours) | Efficiency of Electrolysis (%) |
|---|---|---|---|---|
| | $T_1$ (Positive direction) (seconds) | $t_1$ (Reverse direction) (seconds) | | |
| Example | | | | |
| 1 | 60 | 15 | 1000 or more | 51 |
| 2 | 60 | 10 | 1000 or more | 61 |
| 3 | 60 | 6 | 1000 | 70 |
| 4 | 60 | 4 | 740 | 74 |
| 5 | 60 | 2 | 500 | 80 |
| Comparative Example | | | | |
| 1 | 60 | 1 | 100 | 82 |
| 2 | 60 | 20 | 1000 | 42 or more |
| 3 | continued | — | 95 | 85 |

As clearly shown in Table 1, the electrode life is greatly improved by the periodic current application in the reverse direction. Moreover, the electrode life increases but the efficiency of electrolysis decreases as the current amount in the reverse direction increases. Therefore, the current amount in the reverse direction should be about 3 to 30% of that in the positive direction in order to maintain the efficiency of the entire electrolysis to be 50% or more.

EXAMPLE 2

An electrolytic cell was constructed in the same manner as in Example 1 except that a Ni plate was used for both the anode and cathode. Electrolysis was similarly conducted by supplying a 4% NaOH aqueous solution into the anode compartment, discharging a 2% NaOH aqueous solution from the anode compartment and discharging a 12% NaOH aqueous solution from the cathode compartment. The results obtained are shown in Table 2.

TABLE 2

| | Current-applying Time | | Electrode Life (hours) | Efficiency of Electrolysis (%) |
|---|---|---|---|---|
| | $T_1$ (Positive direction) (seconds) | $t_1$ (Reverse direction) (seconds) | | |
| Example | | | | |
| 1 | 60 | 10 | 2000 | 65 |
| 2 | 60 | 6 | 1300 | 75 |
| 3 | 60 | 4 | 950 | 81 |
| Comparative Example | | | | |
| 1 | 60 | 20 | 2000 or more | 46 |
| 2 | continued | — | 220 | 92 |

EXAMPLE 3

An electrolytic cell partitioned by a cation exchange membrane (tradename Nafion 315, manufactured by Dupont) was constructed in the manner as shown in FIG. 1 and a stainless steel plate (SUS 316) of 10 cm×10 cm size and 2.5 mm thickness was used as the material for both electrodes 4 and 5. First, the left-hand compartment 2 was made to be anode compartment and a NaOH aqueous solution was supplied as the electrolyte. Electrolysis was conducted by applying an electric current in the reverse direction periodically according to the current-applying pattern as shown in FIG. 7.

Next, an electrolyte was supplied to the right-hand compartment 3 by valve operation and electrolysis was similarly continued with inverting the direction of the liquid flow and the direction of the current-application using compartment 3 as the anode compartment. The conditions were as follows:

Electrolyte supplied: 2% NaOH aqueous solution
Solution discharged from the anode compartment: 0.5% NaOH aqueous solution
Solution discharged from the cathode compartment: 12% NaOH aqueous solution
Electrolysis temperature: 55° C.
Current density $A_4=a_4$: 30 A/dm$^2$
Current-applying time $T_4=T'_4$: 60 seconds
Reverse direction $t_4=t'_4$: 6 seconds
Electrolysis time $L=L'$: 300 hours As a result, electrolysis treatment could be continued at a total current efficiency of about 71% for 3000 hours without any problems.

On the contrary, in the case of electrolysis without periodic reverse current-application, the current efficiency was about 86% but the electrolytic voltage increased 5 V or more during about 100 hours of electrolysis and it was impossible to continue further electrolysis.

EXAMPLE 4

A NaOH aqueous solution was recovered from an alkaline waste solution of a Merox process in LPG refining using an electrolytic cell partitioned by a cation exchange membrane (trade name Nafion 324, manufactured by Dupont) and constructed in the manner as shown in FIG. 1 wherein a pure nickel plate of 10 cm×10 cm size and 3 mm thickness was used as the material for both electrodes 4 and 5.

The analytical data of the alkaline waste solution was as follows:

| | |
|---|---|
| NaOH | 6.0% |
| TOC* | 20 g/l |
| $Ca^{++}$ | 20 mg/l |
| $Mg^{++}$ | 5 mg/l |
| $Mn^{++}$ | 5 mg/l |
| $SO_4^{--}$ | 20 mg/l |

*Total Organic Carbon

Using this alkaline waste solution as an electrolyte and supplying it into the left-hand compartment 2 which was used as the anode compartment, electrolysis was conducted under periodic current application in the reverse direction according to the current-applying pattern shown in FIG. 7. Next, the electrolyte was supplied to the right-hand compartment 3 by valve operation and electrolysis was similarly continued with inverting the direction of the liquid flow and the direction of current application using compartment 3 as the anode compartment. Only a pure NaOH aqueous solution was recovered by returning the concentrated NaOH aqueous solution to the original waste solution for 15 minutes from the time when electrolysis had been started after inverting the polarity of the compartments.

The electrolytic conditions were as follows:

| | |
|---|---|
| NaOH concentration of the electrolyte supplied: | 6.0% |
| NaOH concentration of the solution discharged from the anode compartment: | 0.6% |
| Solution from discharged cathode compartment: NaOH aqueous solution | 12% |
| Electrolytic temperature: | 55° C. |
| Current density $A_4 = a_4$: | 30 A/dm$^2$ |
| Current-applying time $T_4 = T'_4$: | 60 seconds |
| Reverse direction $t_4 = t'_4$: | 6 seconds |
| Electrolytic period $L = L'$: | 168 hours (1 week) |

As a result, electrolysis treatment could be continued at a total current efficiency of about 73% for 4500 hours without any problems. Further, the deposition of precipitates on the cation exchange membrane was hardly observed.

On the contrary, in the case of electrolysis wherein periodic current in the reverse direction was not applied, the current efficiency was about 88% but the electrolytic voltage increased 5 V or more during about 100 hours of electrolysis and it was impossible to continue further electrolysis.

In the case where periodic current in reverse direction was applied but the polarity of the compartments was not inverted, the total current efficiency was about 73% and electrolysis could be, at first, conducted for about 1500 hours without any problems but the electrolytic voltage gradually increased. Upon dismounting the cell, the formation of a small amount of non-conductive oxidation product was observed on the anode plate. Moreover, precipitates which were presumably the impurities in the alkaline waste solution supplied, were adhered onto the surface of the cation exchange membrane, whereupon the electric resistance of the cation exchange membrane increased about 2 times.

While the invention has been described in detail and with reference to specific embodiments thereof, it will be apparent to one skilled in the art that various changes and modifications can be made therein without departing from the spirit and scope thereof.

We claim:

1. A method for electrolyzing a dilute caustic alkali aqueous solution comprising:

(a) supplying a dilute caustic alkali aqueous solution into one electrode compartment of an electrolytic cell partitioned by a cation exchange membrane;

(b) electrolyzing the solution therein; and (c) recovering a concentrated caustic alkali aqueous solution from the other electrode compartment, wherein iron, nickel or their base alloys is used as an electrode material and electrolysis is conducted in a manner such that the polarities of the electrodes are reversed after a time period substantially corresponding to the time required to obtain said concentrated caustic alkali aqueous solution.

2. The method as claimed in claim 1, wherein the dilute caustic alkali aqueous solution supplied has an alkali concentration of 10 wt% or less.

3. The method as claimed in claim 1, wherein the dilute caustic aqueous solution is a waste solution from alkali treatment in a petroleum refining process or nuclear energy process facility.

4. A method as claimed in claim 1, wherein the time of applying an initial electric current and every other alternate electric current thereafter is 15 minutes or less.

5. The method as claimed in claim 1, wherein the amount of the electric current applied after the initial electric current and every other alternate electric current thereafter is 3 to 30% of that applied initially.

6. A method for electrolyzing a dilute caustic alkali aqueous solution comprising:

(a) supplying dilute caustic alkali aqueous solution into one electrode compartment of an electrolytic cell partitioned by a cation exchange membrane;

(b) electrolyzing the solution therein; and (c) recovering a concentrated caustic alkali aqueous solution from the other electrode compartment, wherein iron, nickel or their base alloys is used as an electrode material, and electrolysis is conducted for a period of time substantially corresponding to the time required to obtain said concentrated caustic alkali aqueous solution, and then the direction of supplying and discharging the electrolyte is reversed and the direction of current flow is reversed after every said time period.

7. The method as claimed in claim 6, wherein the dilute caustic alkali aqueous solution supplied has an alkali concentration of 10 wt% or less.

8. The method as claimed in claim 6, wherein the dilute caustic aqueous solution is a waste solution from alkali treatment in a petroleum refining process or nuclear energy process facility.

9. The method as claimed in claim 6, wherein the time of applying each interval of an electric current by reversing polarities is 15 minutes or less.

10. The method as claimed in claim 6, wherein the electric current after the initial electric current and every other alternate electric current thereafter is 3 to 30% of that applied initially.

11. The method as claimed in claim 6, wherein the prescribed time is 100 to 1,000 hours.

12. The method as claimed in claim 1, wherein the time of applying an initial electric current and every other alternate electric current thereafter is 15 minutes or less, and the amount of the electric current having opposite polarity to the initial electric current is 3 to 30% of the amount of the initial electric current.

13. The method as claimed in claim 6, wherein the time of applying an initial electric current and every other alternate electric current therafter is 15 minutes or less, and the amount of the electric current having opposite polarity to the initial electric current is 3 to 30% of the amount of the initial electric current.

* * * * *